US009039087B2

(12) United States Patent
Lee et al.

(10) Patent No.: US 9,039,087 B2
(45) Date of Patent: May 26, 2015

(54) CHAIR WITH INTEGRATED BACK PLATE CELL

(71) Applicant: Sidiz, Inc., Gyeonggi-do (KR)

(72) Inventors: Jong Wo Lee, Gyeonggi-do (KR); Tae Hee Ryu, Gyeonggi-do (KR)

(73) Assignee: Sidiz, Inc. (KR)

( * ) Notice: Subject to any disclaimer, the term of this patent is extended or adjusted under 35 U.S.C. 154(b) by 0 days.

(21) Appl. No.: 14/161,874

(22) Filed: Jan. 23, 2014

(65) Prior Publication Data

US 2014/0203609 A1 Jul. 24, 2014

(30) Foreign Application Priority Data

Jan. 23, 2013 (KR) ..... 10-2013-0007613

(51) Int. Cl.
*A47C 7/54* (2006.01)
*A47C 7/40* (2006.01)

(52) U.S. Cl.
CPC .. *A47C 7/54* (2013.01); *A47C 7/402* (2013.01)

(58) Field of Classification Search
CPC ..... A47C 7/402; A47C 7/54
USPC ..... 297/353, 383, 411.41
See application file for complete search history.

(56) References Cited

U.S. PATENT DOCUMENTS 3,215,470 A * 11/1965 Swenson et al. ..... 297/353
7,147,282 B2 * 12/2006 Hatcher et al. ..... 297/353 X
2004/0189073 A1 * 9/2004 Chadwick et al. ..... 297/383

FOREIGN PATENT DOCUMENTS

DE 9314958 U1 * 12/1993 ..... A47C 7/402
DE 9405243 U1 * 7/1995 ..... A47C 7/402
KR 2003360090000 12/2003
KR 2004505500000 10/2010

* cited by examiner

*Primary Examiner* — Anthony D Barfield
(74) *Attorney, Agent, or Firm* — Harness, Dickey & Pierce, P.L.C.

(57) ABSTRACT

A chair capable of allowing positions of armrests and a back plate to be simultaneously adjusted having an integrated back plate cell including a backrest portion and armrest portions extending forward from the backrest portion, a lower frame including a seat plat support portion and an armrest support portion which extends upward from the seat plat support portion and is coupled to each of the armrest portions, and a fixing lever which fixes the armrest portion to the armrest support portion, wherein the integrated back plate cell is obliquely movable relative to the lower frame.

9 Claims, 13 Drawing Sheets

CHAIR WITH INTEGRATED BACK PLATE CELL

CROSS-REFERENCE(S) TO RELATED APPLICATIONS

This application claims priority to Korean Patent Application No(s). 10-2013-0007613, filed on Jan. 23, 2013, the disclosure of which is incorporated herein by reference in its entirety.

BACKGROUND OF THE INVENTION

1. Field

Exemplary embodiments of the present invention relate to a chair, and more particularly, to a chair with an integrated back plate cell, capable of allowing positions of armrests and a back plate to be simultaneously adjusted.

2. Description of the Related Art

In general, a chair includes a seat plate, a back plate coupled to one side of the seat plate, and legs coupled to a lower side of the seat plate. The chair further includes armrests coupled to the seat plate or the back plate to support a user's arms and a headrest coupled to an upper side of the back plate to support a user's head.

In this case, there is a need to adjust a position of each armrest or the back plate according to a user's body condition in the chair. However, since a conventional chair is configured such that the positions of the armrest and the back plate are fixed or respectively adjusted, it may not fully satisfy requirement of a user. Accordingly, in the relater art, the positions of the armrest and the back plate must be adjusted by trial and error so as to be optimized for a user's body.

Particularly, in a case of children and youths growing quickly, it is very important to properly adjust the front and rear positions of the back plate and the up and down positions of the armrest. When the back plate is away from a user's back, a user's upper body may be bent forward because a user does not properly lean back. In addition, when leaning on the back plate, a user may become a supine posture and put strain on a waist thereof. Accordingly, in a case of a user having a small body, the back plate should be moved forward and downward and at the same time the armrest should be lowered. Whereas, in a case of a user having a large body, the back plate should be moved backward and upward and at the same time the armrest should be raised.

In accordance with the conventional chair, it is impossible to adjust the position of the back plate or a complicated structure is required to adjust the position of the back plate. In addition, according to the conventional chair, it is impossible to adjust the position of the armrest or a complicated structure is required to adjust the position of the armrest. Particularly, in a case of children and youths, there is a need to properly combine the front and rear positions of the back plate and the up and down positions of the armrest with each other and simultaneously adjust them. However, it is difficult that a user properly and simultaneously adjusts the positions of the back plate and the armrest by oneself (see Patent Document 1: Korean Utility Model Publication No. 20-0450550 (May 10, 2010) and Patent Document 2: Korean Utility Model Publication No. 20-0336009 (Mar. 12, 2003)).

SUMMARY OF THE INVENTION

An object of the present invention is to provide a chair capable of allowing positions of armrests and a back plate to be simultaneously adjusted, and having a simple and compact structure for facilitating position adjustment and fixing thereof.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a chair with an integrated back plate cell includes an integrated back plate cell including a backrest portion and armrest portions extending forward from the backrest portion, a lower frame including a seat plat support portion and an armrest support portion which extends upward from the seat plat support portion and is coupled to each of the armrest portions, and a fixing lever which fixes the armrest portion to the armrest support portion, wherein the integrated back plate cell is obliquely movable relative to the lower frame.

The armrest portion may be provided with a lever coupling hole, the armrest support portion may be provided with a plurality of lever receiving grooves, and the fixing lever may include a lever shaft portion which is inserted into any one of the plural lever receiving grooves through the lever coupling hole.

The fixing lever may further include an elastic member which is fitted onto an outer peripheral surface of the lever shaft portion to elastically bias the lever shaft portion toward the lever receiving groove.

The fixing lever may further include a catching member which is coupled to one side of the lever coupling hole such that the lever shaft portion passes through the catching member and supports one end of the elastic member.

The other end of the elastic member may be supported by a catching jaw which is protrudingly formed at one side of the outer peripheral surface of the lever shaft portion.

The fixing lever may further include a lever receiving portion which is coupled to one end of the lever shaft portion.

One side of the lever receiving portion may be formed with an assembly groove such that the assembly groove is recessed therefrom, the assembly groove may be formed, at a center of a bottom surface thereof, with a fixing hole, and the assembly groove may be coupled with a lever cap.

The chair with an integrated back plate cell may further include a back plate block which is fixed, at one side thereof, to one side of the armrest portion and is slidably coupled, at the other side thereof, to the armrest support portion.

A first rail may be installed to one side of the armrest support portion, and a second rail, which is correspondingly coupled to the first rail, may be installed to one side of the back plate block.

The armrest support portion may include a fixing ball supported by an elastic body, and the fixing ball may be supported by any one of a plurality of fixing ball receiving grooves provided on the back plate block.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF SPECIFIC EMBODIMENTS

Figure 1:
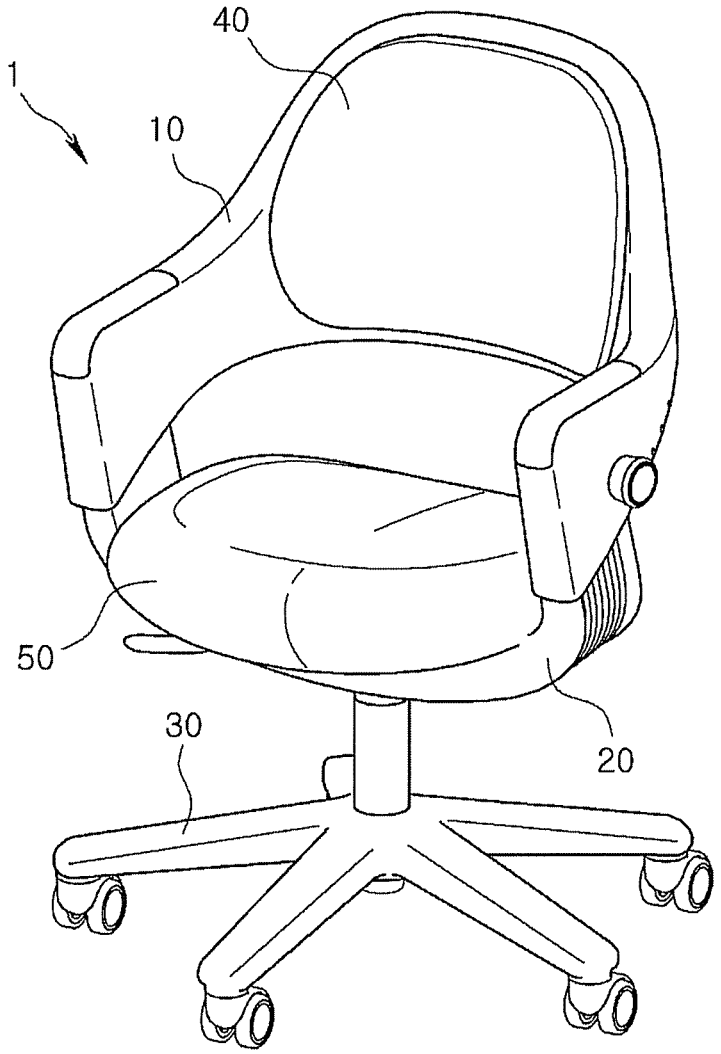
FIG. 1 is a perspective view illustrating a chair with an integrated back plate cell according to an embodiment of the present invention.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention. The drawings are not necessarily to scale and in some instances, proportions may have been exaggerated in order to clearly illustrate features of the embodiments.

It will be understood that when an element is referred to as being "coupled" to another element, it can be directly coupled to the other element or intervening elements may also be present. In contrast, when an element is referred to as being "directly coupled" to another element, there are no intervening elements present. It will be further understood that the terms "comprises" when used in this specification, specify the presence of stated features, integers, steps, operations, elements, and/or components, but do not preclude the presence or addition of one or more other features, integers, steps, operations, elements, components, and/or groups thereof.

Hereinafter, an embodiment of the present invention will be described in more detail with reference to the accompanying drawings.

Figure 2:
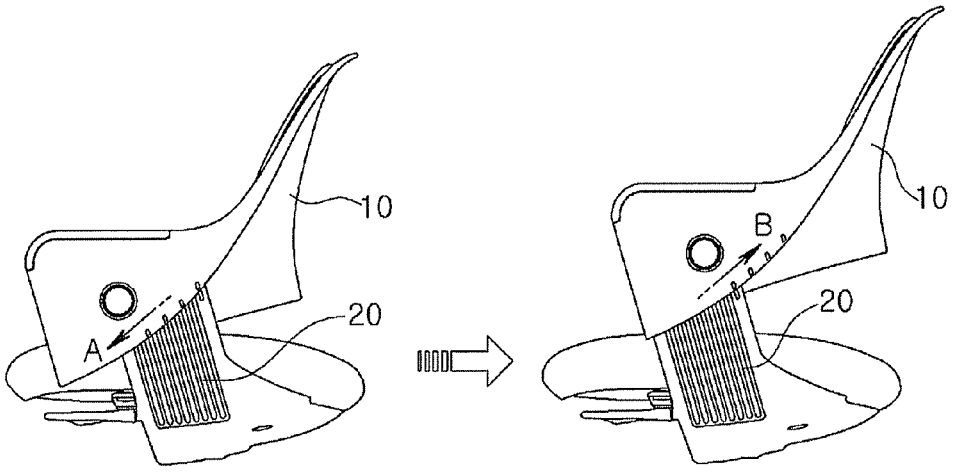
FIG. 2 is a side view illustrating a use state of the chair with an integrated back plate cell according to the embodiment of the present invention.
Figure 3:
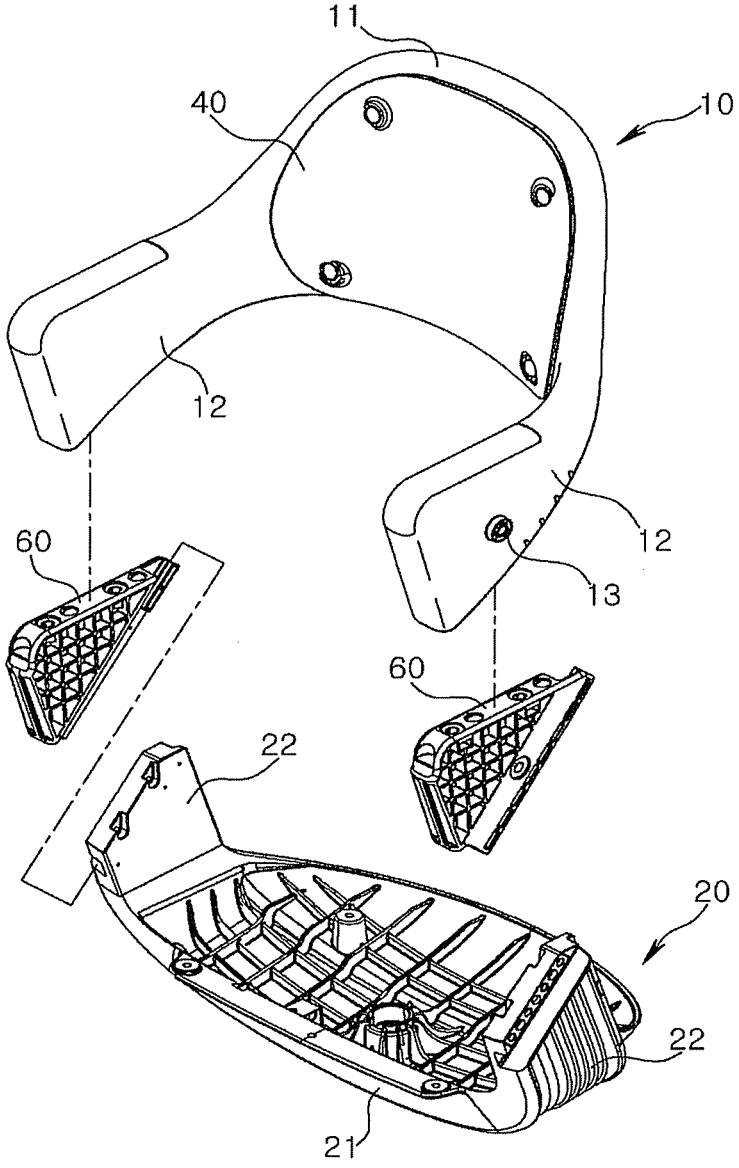
FIG. 3 is an exploded perspective view illustrating the chair with an integrated back plate cell according to the embodiment of the present invention.

FIG. 1 is a perspective view illustrating a chair with an integrated back plate cell according to an embodiment of the present invention. FIG. 2 is a side view illustrating a use state of the chair with an integrated back plate cell according to the embodiment of the present invention. FIG. 3 is an exploded perspective view illustrating the chair with an integrated back plate cell according to the embodiment of the present invention.

As shown in FIG. 1, a chair with an integrated back plate cell 1 (hereinafter, referred to as "chair") according to an embodiment of the present invention includes an integrated back plate cell 10 and a lower frame 20 coupled to a lower side of the integrated back plate cell 10.

In addition, the chair 1 may further includes a leg portion 30 coupled to a lower side of the lower frame 20, a back plate cushion 40 coupled to one side of the integrated back plate cell 10 to support a user's back part, and a seat plate cushion 50 provided at an upper side of the lower frame 20 to support a user's hip part.

As shown in FIG. 2, the integrated back plate cell 10 may be obliquely moved relative to the lower frame 20, and a detailed description thereof will be given later.

As shown in FIG. 3, the integrated back plate cell 10 may include a backrest portion 11 and a pair of armrest portions 12 extending forward from both sides of the backrest portion 11.

In the present invention, the term "integrated back plate cell" means a member in which the backrest portion 11 capable of supporting a user's back is coupled to the armrest portions 12 capable of supporting a user's arms, and it is not necessarily intended that the backrest portion 11 and the armrest portions 12 are made of one structure. In addition, the integrated back plate cell 10 may be integrally or separately coupled with other elements such as a waist rest portion (a lumbar support).

The lower frame 20 may include a seat plat support portion 21 and a pair of armrest support portions 22 which respectively extend upward from both sides of the seat plat support portion 21.

In this case, the lower frame 20 may be configured in such a way that the seat plat support portion 21 and the armrest support portions 22 which are respectively separate parts are coupled to each other or the seat plat support portion 21 and the armrest support portions 22 are integrally formed.

In this case, the seat plat support portion 21 may be coupled, at an upper side thereof, with a seat plate or the seat plate cushion 50, and the armrest support portions 22 are obliquely and movably coupled to the armrest portions 12 of the integrated back plate cell 10.

To this end, a back plate block 60 is arranged between each of the armrest portions 12 of the integrated back plate cell 10 and each of the armrest support portions 22 of the lower frame 20.

In this case, the back plate block 60 is inserted into, for example, an opening portion (not shown) formed at a lower side of the armrest portion 12 of the integrated back plate cell 10 to be capable of being fixed to the armrest portion 12.

Here, as a lower end of the armrest portion 12 of the integrated back plate cell 10 and an upper end of the armrest support portion 22 of the lower frame 20 are obliquely formed so as to correspond to each other, the integrated back plate cell 10 may be obliquely moved relative to the lower frame 20.

That is, as shown in FIG. 2, the integrated back plate cell 10 may move in each of "A" and "B" directions relative to the fixed lower frame 20. Due to such oblique movement, vertical positions and front and rear positions of the backrest portion 11 and the armrest portion 12 may be simultaneously adjusted.

For example, when the integrated back plate cell 10 moves in the "A" direction relative to the lower frame 20, the backrest portion 11 is lowered and moved forward (that is, an area by which a user's hip part may be supported on the seat plate being small), and at the same time the armrest portion 12 is lowered. In contrast, when the integrated back plate cell 10 moves in the "B" direction relative to the lower frame 20, the backrest portion 11 is raised and moved backward (that is, an area by which a user's hip part may be supported on the seat plate being large), and at the same time the armrest portion 12 is raised.

Accordingly, it may be possible to provide the chair 1 having a simple and compact structure capable of simultaneously adjusting the positions of the backrest portion 11 and the armrest portion 12. In addition, a user may maintain a suitable seated posture and it may be possible to prevent spine deformity and the like due to a bad posture.

Meanwhile, when an angle by which the integrated back plate cell 10 obliquely moves relative to the lower frame 20 is too large or small, simultaneously adjusting the positions of the backrest portion 11 and the armrest portion 12 may not be very meaningful. Consequently, it may be impossible to provide a superior seating feeling for a user. Particularly, an adjustment ratio between a depth of the back plate and a height of the armrest which is suitable for growth speed of children is approximately 1:1.

Accordingly, an angle by which the integrated back plate cell 10 obliquely moves relative to the lower frame 20 is preferably within a range of 30° to 60° based on the ground. This is because the height adjustment of the armrest portion 12 is not easy when the oblique movement angle is below 30° and the depth adjustment of the backrest portion 11 is not easy when the oblique movement angle is above 60°.

Figure 4:
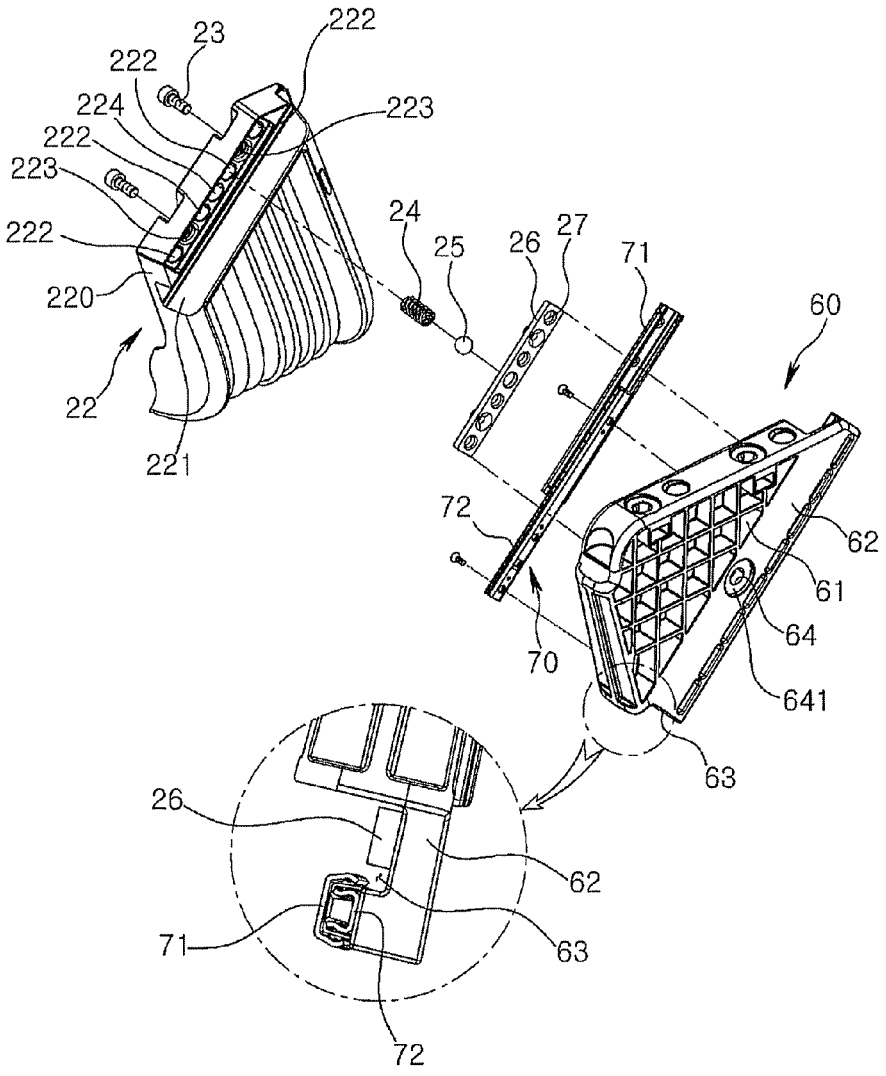
FIG. 4 is a partially enlarged perspective view illustrating a back plate block and an armrest support portion in FIG. 3.
Figure 5:
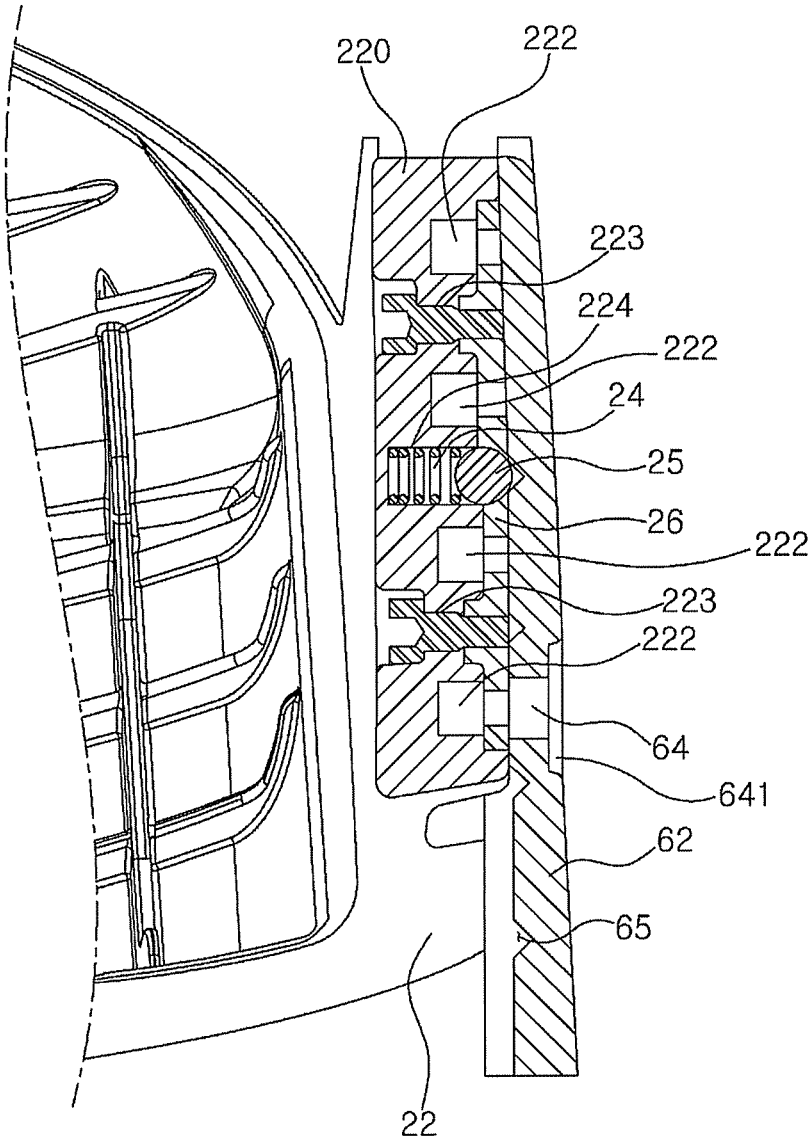
FIG. 5 is a cross-sectional view illustrating an inclined surface between the armrest support portion and an armrest portion in FIG. 3.

FIG. 4 is a partially enlarged perspective view illustrating the back plate block and the armrest support portion in FIG. 3. FIG. 5 is a cross-sectional view illustrating an inclined surface between the armrest support portion and the armrest portion in FIG. 3.

As shown in FIG. 4, one side of an upper end portion of the armrest support portion 22 of the lower frame 20 is formed with an upper side coupling portion 220 having a "ㄱ" shape, and one side of the upper side coupling portion 220 is formed with a receiving groove 221.

In this case, the upper side coupling portion 220 of the lower frame 20 is correspondingly coupled to a receiving groove 63 of the back plate block 60 to be described later, and the receiving groove 221 of the lower frame 20 is correspondingly coupled with a block coupling portion 62 of the back plate block 60 to be described later.

In addition, the upper side coupling portion 220 is provided with a plurality of lever receiving grooves 222, bolt receiving grooves 223, and an elastic boy receiving groove 224, as shown in FIG. 5. An elastic body 24 and a fixing ball 25 may be inserted into the elastic boy receiving groove 224. The elastic body 24 may be, for example, a coil spring and the fixing ball may be, for example, a steel ball (an iron ball).

In a state in which the elastic body 24 and the fixing ball 25 are received in the elastic boy receiving groove 224, a fixing ball separation preventing frame 26 is fixed to the upper side coupling portion 220 of the armrest support portion 22 by bolts 23.

In this case, the fixing ball separation preventing frame 26 is penetratively formed with fastening holes 27 which respectively correspond to the plural lever receiving grooves 222 and a plurality of apertures which respectively correspond to the bolt receiving grooves 223 and the elastic body receiving groove 224.

In addition, in a state in which the fixing ball 25 is elastically supported by the elastic body 24, the fixing ball 25 corresponds to the elastic body receiving groove 224 at one side of an outer peripheral surface thereof and protrudes outwardly through the apertures formed on the fixing ball separation preventing frame 26. One side of the outer peripheral surface of the protruded fixing ball 25 is supported by any one of a plurality of fixing ball receiving grooves 65 provided on the back plate block 60 so as to have, for example, a wedged shape.

Accordingly, when the integrated back plate cell 10 slides relative the lower frame 20, the fixing ball 25 moves inwardly against elastic force of the elastic body 24 by contact pressure with the back plate block 60, and then reaches a new fixing ball receiving groove 65. In this way, the integrated back plate cell 10 may be fixed at a position which is stepwisely determined relative to the lower frame 20 (in this case, the number of steps being determined depending upon the number of the fixing ball receiving grooves).

Meanwhile, the back plate block 60 includes a block body portion 61 and a block coupling portion 62 which is coupled to one side of a lower end portion of the block body portion 61 in the form of "ㄴ", and one side of the block coupling portion 62 is formed with a receiving groove 63. In this case, as described above, the block coupling portion 62 and the receiving groove 63 of the back plate block 60 are correspondingly coupled with the receiving groove 221 of the upper side coupling portion 220 of the lower frame 20.

The upper side coupling portion 220 of the armrest support portion 22 and the block coupling portion 62 of the back plate block 60 may be coupled to each other so as to slide relative to each other by a moving rail 70.

In this case, the moving rail 70 includes a first rail 71 and a second rail 72 which are relatively and movably coupled to each other. The first rail 71 may be fixed to the upper side coupling portion 220 and the second rail 72 may be fixed to the block coupling portion 62. Consequently, the back plate block 60 is movably coupled to the armrest support portion 22.

Figure 6:
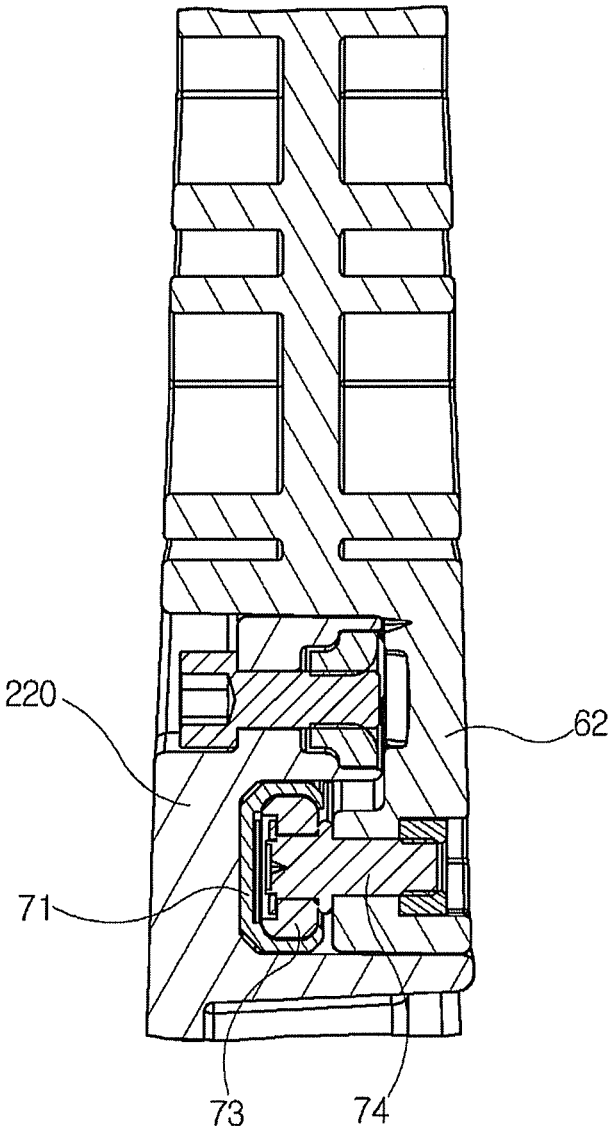
FIG. 6 is a cross-sectional view illustrating a coupling between a first rail and a roller according to another embodiment of the present invention.

FIG. 6 is a cross-sectional view illustrating a coupling between a first rail and a roller according to another embodiment of the present invention.

In the above-mentioned embodiment, the back plate block 60 is movably coupled to the armrest support portion 22 by the first rail 71 fixed to the upper side coupling portion 220 and the second rail 72 fixed to the block coupling portion 62.

Unlike this, according to another embodiment of the present invention, as shown in FIG. 6, one side of the block coupling portion 62 may be provided with a moving roller 73 instead of the second rail 72. In this case, the moving roller 73 is rotatably and correspondingly coupled to a rail groove of the first rail 71 and a rotary shaft 74 of the moving roller 73 is coupled to one side of the block coupling portion 62.

Thus, when the moving roller 73 moves while rotating along the first rail 71, the integrated back plate cell 10 slides relative the armrest support portion 22 of the lower frame 20 together with the back plate block 60.

Figure 7:
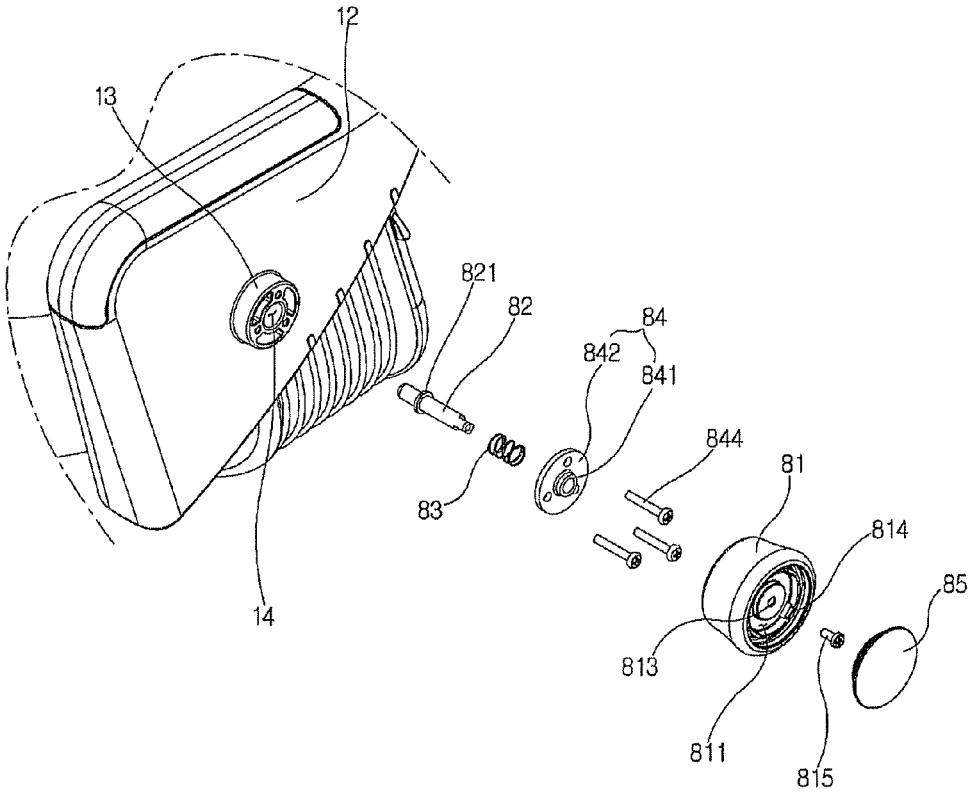
FIG. 7 is a partially exploded perspective view illustrating the armrest portion and a fixing lever in FIG. 3.
Figure 8:
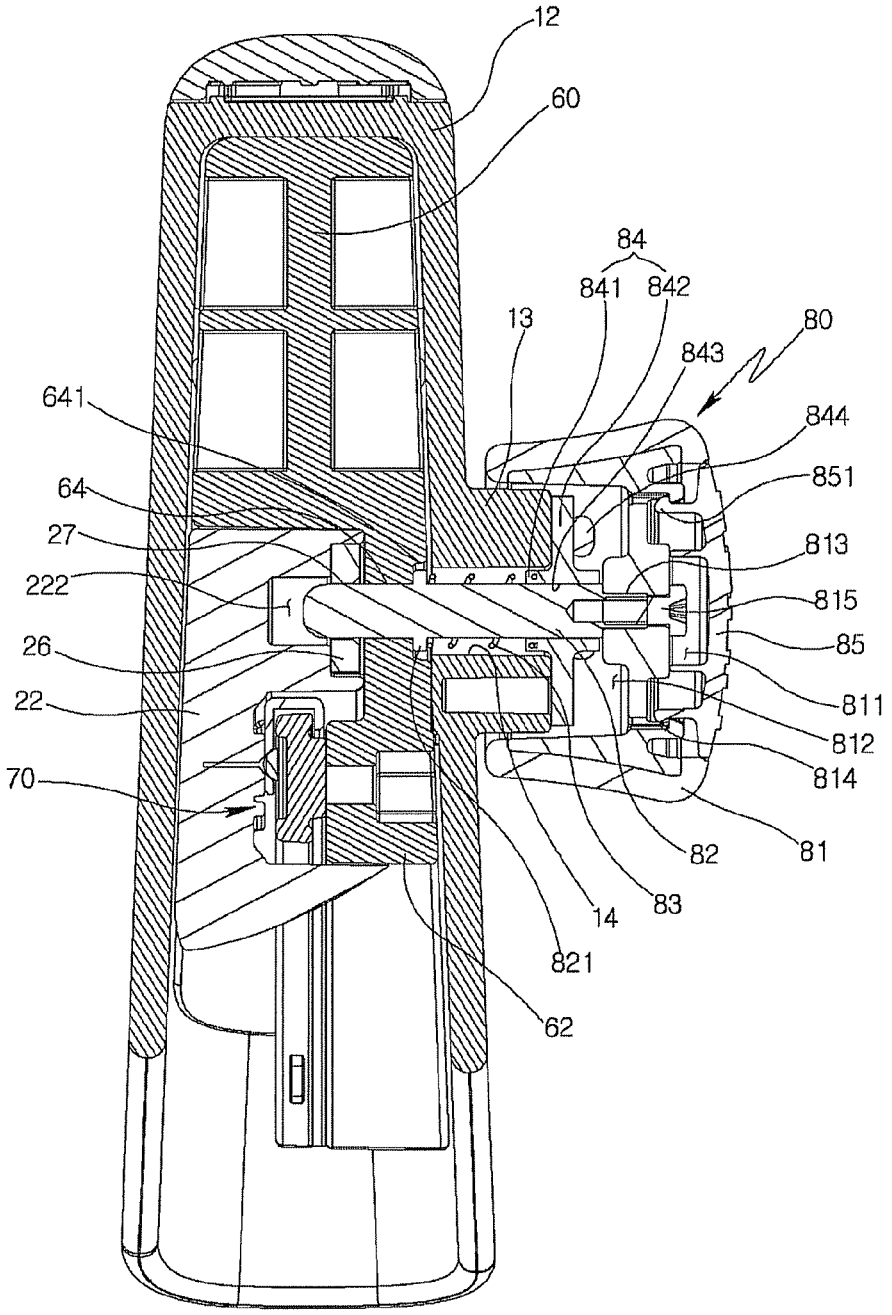
FIG. 8 is a cross-sectional view illustrating the armrest portion, the armrest support portion, and the fixing lever in FIG. 3.

FIG. 7 is a partially exploded perspective view illustrating the armrest portion and a fixing lever in FIG. 3. FIG. 8 is a cross-sectional view illustrating the armrest portion, the armrest support portion, and the fixing lever in FIG. 3.

As shown in FIGS. 7 and 8, the armrest support portion 12 is protrudingly formed, at an outer side thereof, with a cylindrical shaft support portion 13. A fixing lever 80, which is inserted through a lever coupling hole 14 provided on the shaft support portion 13, is coupled to the back plate block 60 and the armrest support portion 22 to fix the armrest portion 12 to the armrest support portion 22.

Here, the fixing lever 80 includes a lever receiving portion 81 which is grasped and operated by a user, a lever shaft portion 82 which is coupled, at one end thereof, to the lever receiving portion 81 while being inserted, at the other end thereof, into the lever receiving groove 222 of the armrest support portion 22, an elastic member 83 which elastically biases the lever shaft portion 82 toward the lever receiving groove 222, and a catching member 84 coupled to the lever coupling hole 14 to support one end of the elastic member 83.

In this case, the lever receiving portion 81 is formed in the form of a cylindrical or polygonal block such that a user may easily grasp and operate the lever receiving portion 81.

In addition, one side of the lever receiving portion 81 is formed with an assembly groove 811 such that the assembly groove 811 is recessed therefrom and the other side thereof is formed with a shaft support portion receiving groove 812 such that the shaft support portion receiving groove 812 is recessed therefrom. One side of the lever receiving portion 81 is coupled to the armrest portion 12 such that the shaft support portion receiving groove 812 surrounds an outer peripheral surface of the shaft support portion 13.

In addition, the assembly groove 811 is formed, at a center of a bottom surface thereof, with a fixing hole 813. As described later, one end of the lever shaft portion 82 is inserted into the fixing hole 813 to be fixed by a fastener such as a bolt 815.

In this case, a lever cap 85 is fitted into the assembly groove 811 of the lever receiving portion 81 so as to close the assembly groove 811. A plurality of fitting grooves 814 are formed on an inner peripheral surface of the assembly groove 811 and a plurality of fitting protrusions 851 are protrudingly formed at one side of the lever cap 85 so as to be correspondingly coupled to the fitting grooves 814 of the assembly groove 811.

The lever shaft portion 82 is fixed, at one end thereof, to the lever receiving portion 81 by the bolt 815, and is inserted, at other end thereof, into the lever receiving groove 222 of the armrest support portion 222 via the lever coupling hole 14 of the shaft support portion 13, a through hole 64 of the back plate block 60, and the fastening hole 27 of the fixing ball separation preventing frame 26.

In this case, one end of the lever shaft portion 82 fixed to the lever receiving portion 81 preferably has a smaller width than the other end thereof inserted into the lever receiving groove 222.

In addition, as the integrated back plate cell 10 obliquely moves relative to the lower frame 20, the lever shaft portion 82 is selectively inserted into any one of the plural lever receiving grooves 222 formed on the armrest support portion 22 to fix the position of the integrated back plate cell 10 relative to the lower frame 20.

Moreover, the lever shaft portion 82 is elastically biased toward the lever receiving groove 222 by the elastic member 83 such as a coil spring fitted onto the outer peripheral surface of the lever shaft portion 82.

In this case, one side of the outer peripheral surface of the lever shaft portion 82 is protrudingly formed with an annular catching jaw 821 and an edge of the through hole 64 of the back plate block 60 is formed with a seating groove 641 which is recessed by a thickness of the catching jaw 821, thereby receiving the catching jaw 821 during insertion of the lever receiving groove 222 of the lever shaft portion 82.

In addition, the catching member 84 is coupled to the outer side of the lever coupling hole 14 of the shaft support portion 13. In this case, the catching member 84 is formed in a cylindrical shape having a through hole 843 at a center thereof. The catching member 84 includes an insertion portion 841 which is inserted, at one side thereof, into the lever coupling hole 14, and a body portion 842 which has an enlarged width along an edge of an outer peripheral surface of the insertion portion 841 and is fixed along an edge of the outer side of the lever coupling hole 14 by a fastener such as a bolt 844.

In this case, one end of the elastic member 83 is elastically supported by one end of the insertion portion 841 of the catching member 84 and the other end thereof is elastically supported by the catching jaw 821 of the lever shaft portion 82.

As such, the catching member 84 is fixed to the edge of the lever coupling hole 14 of the shaft support portion 13 and the lever shaft portion 82 is inserted through the through hole of the catching member 84. Thus, when the lever shaft portion 82 is separated from the lever receiving groove 222 by outwardly pulling the armrest portion 12, the elastic member 83 interposed between the lever shaft portion 82 and the catching member 84 is contracted while the catching jaw 821 of the lever shaft portion 82 moves toward the catching member 84. When force pressing the lever shaft portion 82 is removed, the lever shaft portion 82 is again inserted into the lever receiving groove 222 by elastic restoring force of the elastic member 83.

That is, when a user pulls the lever receiving portion 81 toward the outer side of the armrest portion 12, the lever shaft portion 82 is separated from the lever receiving groove 222 of the armrest support portion 22 and the armrest portion 12 and the back plate block 60 are freely movable relative to the armrest support portion 22. Consequently, a user may obliquely move the integrated back plate cell 10 relative to the lower frame 20.

When a user obliquely moves the integrated back plate cell 10 relative to the lower frame 20 and then releases the lever receiving portion 81, the lever shaft portion 82 is again inserted into the lever receiving groove 222 of the armrest support portion 22 by elastic restoring force of the elastic member 83, thereby allowing the position of the integrated back plate cell 10 relative to the lower frame 20 to be fixed.

Figure 9:
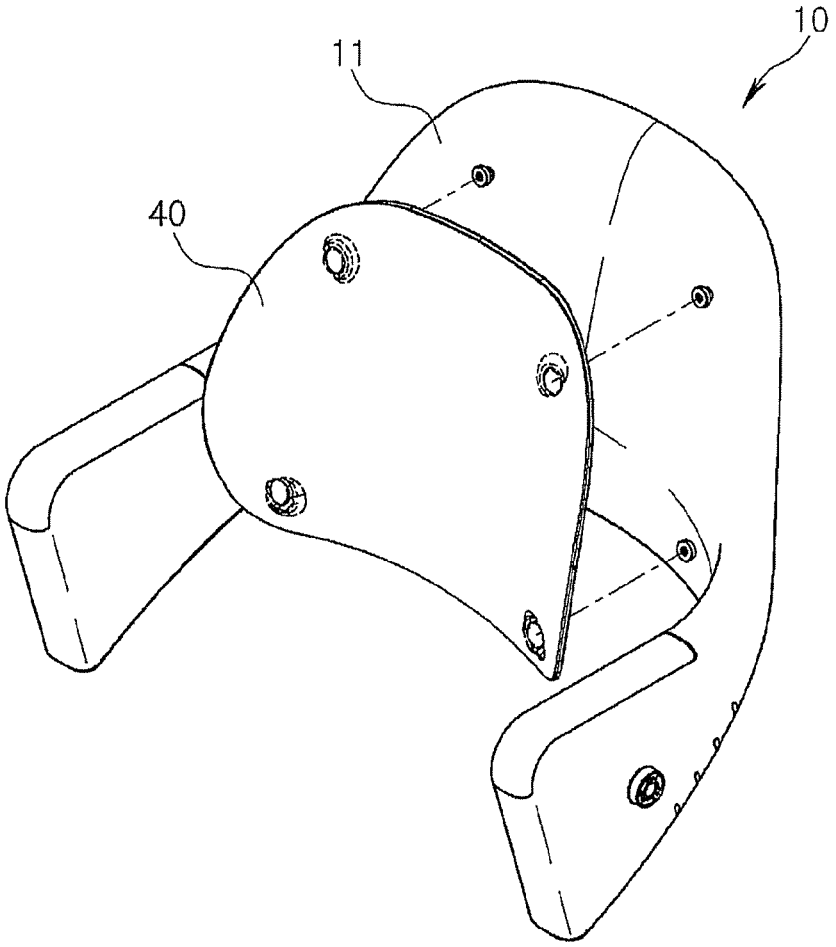
FIG. 9 is an exploded perspective view illustrating a backrest portion in FIG. 3.
Figure 10:
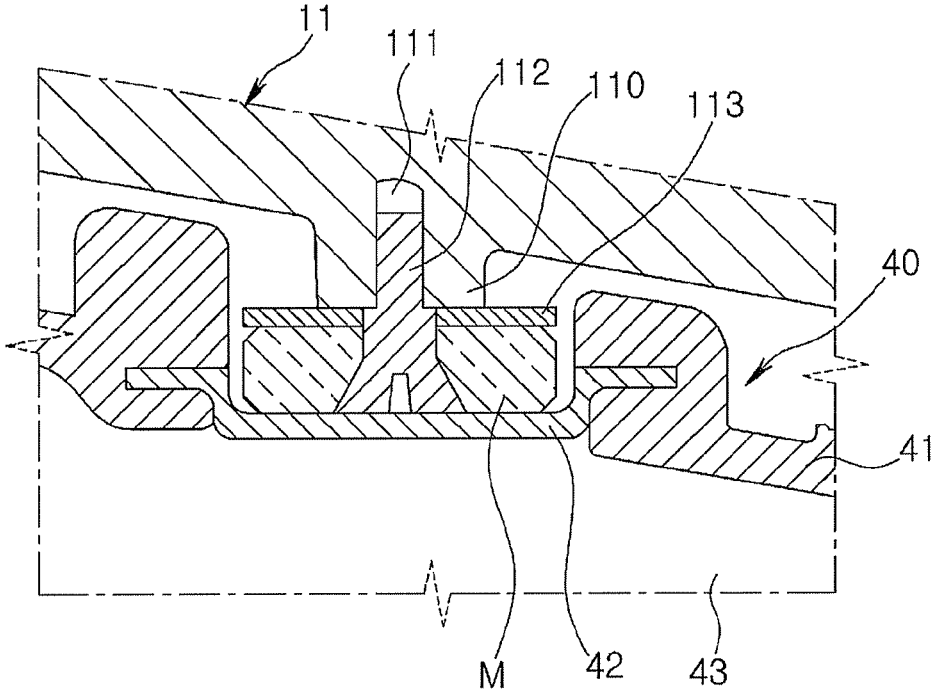
FIG. 10 is a cross-sectional view illustrating a state in which a back plate cushion is coupled to the backrest portion in FIG. 9.

FIG. 9 is an exploded perspective view illustrating the backrest portion in FIG. 3. FIG. 10 is a cross-sectional view illustrating a state in which the back plate cushion is coupled to the backrest portion in FIG. 9.

As shown in FIG. 9, the backrest portion 11 of the integrated back plate cell 10 may be detachably coupled with the back plate cushion 40. Hereinafter, a coupling structure between the backrest portion 11 and the back plate cushion 40 will be described with reference to FIG. 10.

The backrest portion 11 of the integrated back plate cell 10 is formed with a protrusion portion 110 protruding forward, and the protrusion portion 110 is formed with a bolt receiving groove 111.

In this case, a magnetic substance M such as a permanent magnet may be fixed to the front of the protrusion portion 110 by a bolt 112, and a body portion 41 of the back plate cushion 40 may be provided with a coupling member 42 corresponding to the protrusion portion 110. The coupling member 42 may be a metal capable of being combined with the magnetic substance M. Such a metal may be attached to one side of the back plate cushion 40 by insert injection molding. Unlike this, the coupling member 42 may be a magnetic substance.

Meanwhile, the back plate cushion 40 may further include a cushion portion 43 which is made of a material such as fabric, leather, or resin and provides a comfortable feeling for a user. In this case, the cushion portion 43 is provided at one side of the body portion 41 or surrounds the body portion 41.

The back plate cushion 40 may be detachably coupled to the integrated back plate cell 10. As a result, it may be possible to enhance a user's seating feeling and improve convenience for washing or cleaning of the back plate cushion 40 during contamination thereof.

Meanwhile, although the above description is given as the backrest portion 11 being provided with the magnetic substance M and the back plate cushion 40 being provided with the coupling member 42, the backrest portion 11 may also be provided with the coupling member and the back plate cushion 40 may also be provided with the magnetic substance M.

Figure 11:
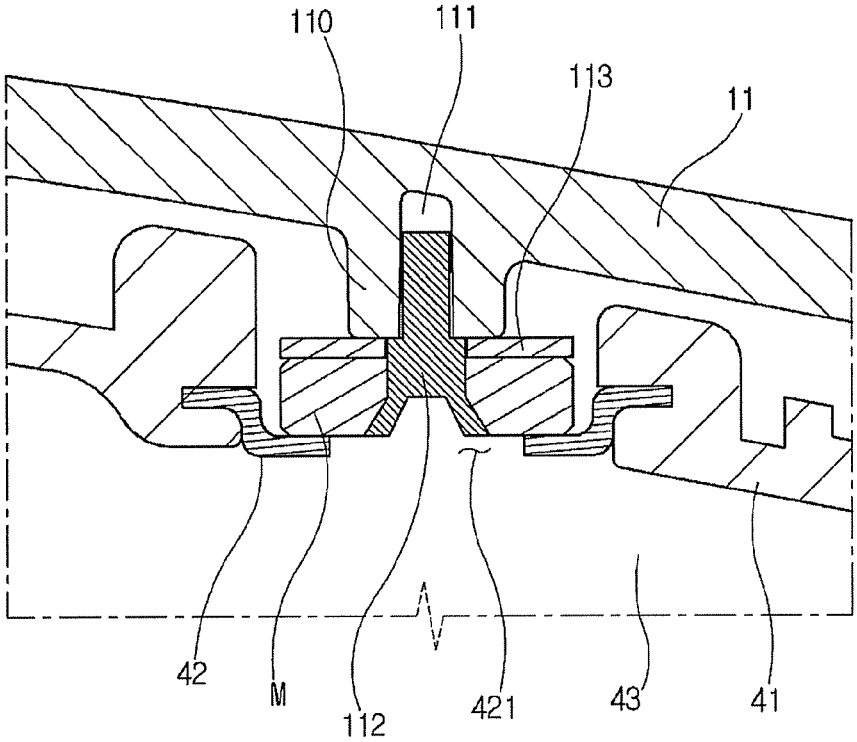
FIG. 11 is a cross-sectional view illustrating a state in which a back plate cushion is coupled to a backrest portion according to another embodiment of the present invention.

FIG. 11 is a cross-sectional view illustrating a state in which a back plate cushion is coupled to a backrest portion according to another embodiment of the present invention.

Another embodiment of the present invention shown in FIG. 11 is similar to the above-mentioned embodiment in that the back plate cushion 40 is detachably coupled to the backrest portion 11 by the magnetic substance M, but differs from the above-mentioned embodiment in that the coupling member 42 is formed with a fastening hole 421.

In this case, in a state in which the magnetic substance M is attached to the coupling member 42 of the body portion 41 of the back plate cushion 40, a user may couple the back plate cushion 40 to the backrest portion 11 by fastening the bolt 112 to the bolt receiving groove 111 through the fastening hole 421.

In addition, similarly to the above-mentioned embodiment shown in FIG. 10, the coupling member 42 of the body portion 41 of the back plate cushion 40 may also be attached to the magnetic substance M in a state in which the magnetic substance M is fixed to the protrusion portion 110. In this case, since the position of the magnetic substance M is identified through the fastening hole 421, the back plate cushion 40 may be accurately and easily attached to the backrest portion 11.

In addition, a washer 113 for reinforcement of magnetic force may be interposed between the protrusion portion 110 and the magnetic substance M. The washer 113 may also be similarly applied to the above-mentioned embodiment with reference to FIG. 10.

Figure 12:
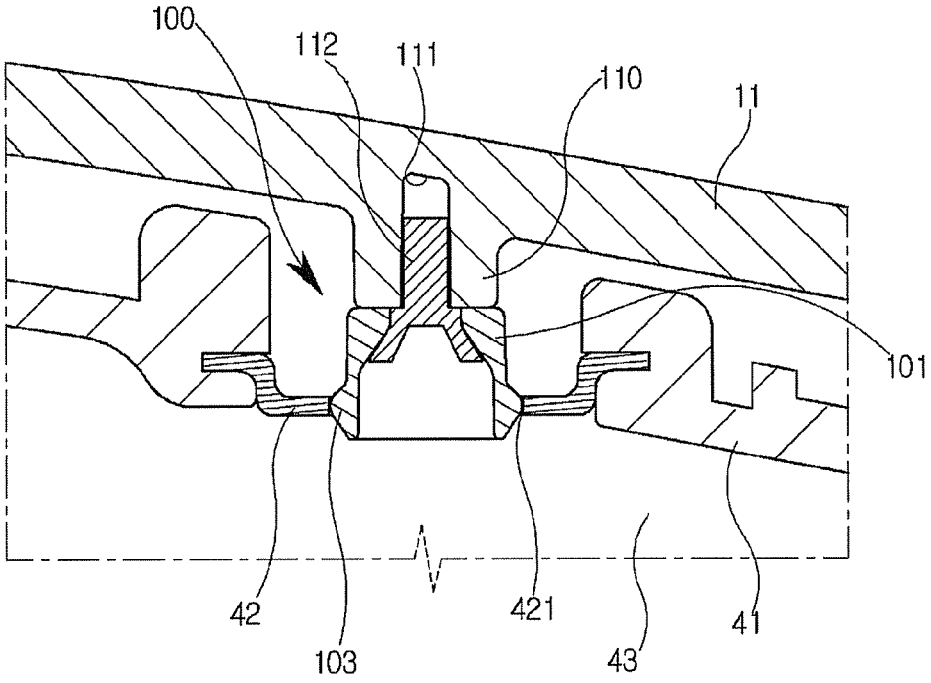
FIG. 12 is a cross-sectional view illustrating a state in which a back plate cushion is coupled to a backrest portion according to a further embodiment of the present invention.
Figure 13A:
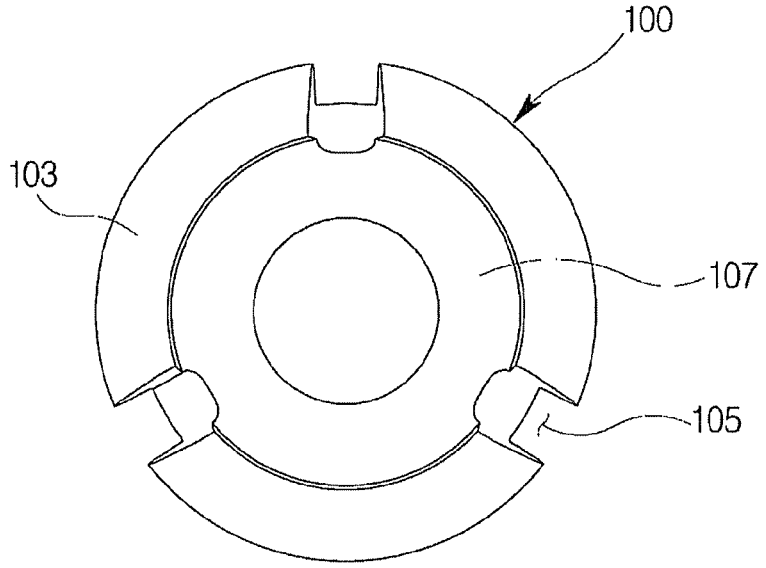
FIG. 13A is a top view illustrating a snap shown in FIG. 12.
Figure 13B:
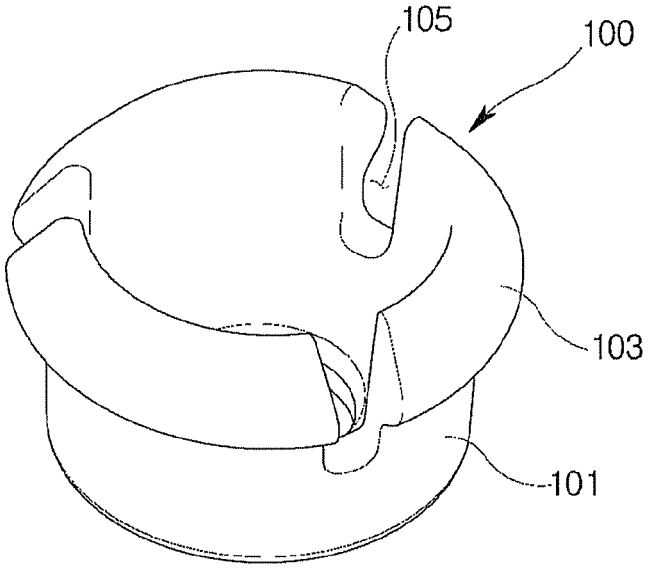
FIG. 13B is a perspective view illustrating the snap shown in FIG. 12.

FIG. 12 is a cross-sectional view illustrating a state in which a back plate cushion is coupled to a backrest portion according to a further embodiment of the present invention. FIG. 13A is a top view illustrating a snap shown in FIG. 12. FIG. 13B is a perspective view illustrating the snap shown in FIG. 12.

In accordance with a further embodiment of the present invention shown in FIG. 12, a back plate cushion 40 is detachably coupled to a backrest portion 11 by a snap 100.

In this case, the backrest portion 11 of the integrated back plate cell 10 is formed with a protrusion portion 110 protruding forward, and the cylindrical snap 100 is fixed to the front of the protrusion portion 110 by a bolt 112.

In addition, a body portion 41 of the back plate cushion 40 may be provided with a coupling member 42 which corresponds to the protrusion portion 110 and is formed with a fastening hole 421. The back plate cushion 40 may be coupled to the backrest portion 11 by fitting the snap 100 into the fastening hole 421.

Here, as shown in FIGS. 13A and 13B, the snap 100 generally includes a cylindrical body 101 having a hollow and a catching portion 103 protruding outwardly along an edge of an upper end of the body 101. The catching portion 103 is formed with a plurality of cut grooves 105 which are spaced apart from each other by a predetermined distance and thus the catching portion 103 may be elastically deformed.

In addition, the body 101 is formed, at a bottom surface thereof, with a blot support portion 107 which supports a head portion of the bolt 112 along an edge of the hollow.

An assembly of the back plate cushion according to the further embodiment of the present invention is performed as follows.

First, the snap 100 is fastened to the protrusion portion 110 by the bolt 112. In this case, the head portion of the bolt 112 is supported by the bolt support portion 107 of the snap 100.

Subsequently, after the back plate cushion 40 is positioned such that the coupling member 42 faces the snap 100, the back plate cushion 40 is pressed toward the backrest portion 11, thereby allowing the catching portion 103 of the snap 100 to be supported by the edge of the fastening hole 421 of the coupling member 42.

In this case, as the outer peripheral surface of the catching portion 103 is gently formed in a convex curved surface, the catching portion 103 is inserted into the fastening hole 421 while being elastically deformed and is elastically supported by the edge of the fastening hole 421 when passing through the fastening hole 421.

As is apparent from the above description, a chair with an integrated back plate cell according to an embodiment of the present invention has a simple and compact structure capable of facilitating to simultaneously adjust and fix positions of armrests and a back plate.

Particularly, in a case of children and youths, a user may maintain a suitable seated posture by properly combining the front and rear positions of the back plate and the up and down positions of the armrests with each other to simultaneously adjust them. Accordingly, it may be possible to provide a superior seating feeling for a user and prevent spine deformity and the like due to a bad posture.

The technical effect of the present invention described above is not limited to the effect described above and other technical effects not stated herein can be clearly understood by those skilled in the art from the detailed description and the following claims.

While the present invention has been described with respect to the specific embodiments, it will be apparent to those skilled in the art that various changes and modifications may be made without departing from the spirit and scope of the invention as defined in the following claims.

What is claimed is:

1. A chair with an integrated back plate cell comprising:

an integrated back plate cell comprising a backrest portion and armrest portions extending forward from the backrest portion;

a lower frame comprising a seat plat support portion and an armrest support portion which extends upward from the seat plat support portion and is coupled to each of the armrest portions; and a fixing lever which fixes the armrest portion to the armrest support portion, wherein the integrated back plate cell is obliquely movable relative to the lower frame, the armrest portion is provided with a lever coupling hole and the armrest support portion is provided with a plurality of lever receiving grooves, and the fixing lever comprises a lever shaft portion which is inserted into any one of the plural lever receiving grooves through the lever coupling hole.

2. The chair with an integrated back plate cell according to claim 1, wherein the fixing lever further comprises an elastic member which is fitted onto an outer peripheral surface of the lever shaft portion to elastically bias the lever shaft portion toward the lever receiving groove.

3. The chair with an integrated back plate cell according to claim 2, wherein the fixing lever further comprises a catching member which is coupled to one side of the lever coupling hole such that the lever shaft portion passes through the catching member and supports one end of the elastic member.

4. The chair with an integrated back plate cell according to claim 3, wherein the other end of the elastic member is supported by a catching jaw which is protrudingly formed at one side of the outer peripheral surface of the lever shaft portion.

5. The chair with an integrated back plate cell according to claim 2, wherein the fixing lever further comprises a lever receiving portion which is coupled to one end of the lever shaft portion.

6. The chair with an integrated back plate cell according to claim 5, wherein one side of the lever receiving portion is formed with an assembly groove such that the assembly groove is recessed therefrom, the assembly groove is formed, at a center of a bottom surface thereof, with a fixing hole, and the assembly groove is coupled with a lever cap.

7. The chair with an integrated back plate cell according to claim 1, further comprising a back plate block which is fixed, at one side thereof, to one side of the armrest portion and is slidably coupled, at the other side thereof, to the armrest support portion.

8. The chair with an integrated back plate cell according to claim 7, wherein a first rail is installed to one side of the armrest support portion, and a second rail, which is correspondingly coupled to the first rail, is installed to one side of the back plate block.

9. The chair with an integrated back plate cell according to claim 7, wherein the armrest support portion comprises a fixing ball supported by an elastic body, and the fixing ball is supported by any one of a plurality of fixing ball receiving grooves provided on the back plate block.

* * * * *